United States Patent [19]

Carr

[11] Patent Number: 4,634,014

[45] Date of Patent: Jan. 6, 1987

[54] DISPOSABLE ASHTRAY ATTACHMENT FOR BEVERAGE CANS

[76] Inventor: Morris L. Carr, 2836 Sierra Canyon Way, Hacienda Heights, Calif. 91745

[21] Appl. No.: 820,017

[22] Filed: Jan. 21, 1986

[51] Int. Cl.[4] ..... A24F 19/00

[52] U.S. Cl. ..... 220/1 H; 220/90.4; 206/496; 131/257; 131/231

[58] Field of Search ..... 220/1 H, 90.2, 90.4, 220/90.6, 85 F; 206/496; 131/231, 257

[56] References Cited

U.S. PATENT DOCUMENTS

| | | | |
|---|---|---|---|
| 2,152,285 | 3/1939 | Schirmer | 131/51 |
| 2,158,770 | 5/1939 | Bartlett | 131/51 |
| 2,653,616 | 9/1953 | Selgas | 131/257 |
| 2,693,685 | 11/1954 | Stafford | 220/90.6 |
| 2,714,464 | 8/1955 | Cline | 220/1 |
| 2,796,211 | 6/1957 | Wagner | 206/496 X |
| 3,364,937 | 1/1968 | D'Amaro | 131/257 |
| 3,620,225 | 11/1971 | Bailey | 131/235 |
| 4,133,319 | 1/1979 | Bloomfield | 131/241 |
| 4,187,864 | 2/1980 | Taddeo | 220/1 H X |

*Primary Examiner*—Steven M. Pollard
*Attorney, Agent, or Firm*—Frederick E. Mueller

[57] ABSTRACT

A disposable ashtray for use on an open pop top beverage can. The tray is formed out of a flat blank of an aluminized paper sheet that has been scored to define a floor and erectable side walls for the tray. The floor is formed with (1) a passage to matingly receive the actuator tab of the pop top can and (2) a perforated score line defining a key tab portion that is displaced out of the plane of the floor to penetrate through the drink opening of the can.

18 Claims, 4 Drawing Figures

FIG. 1
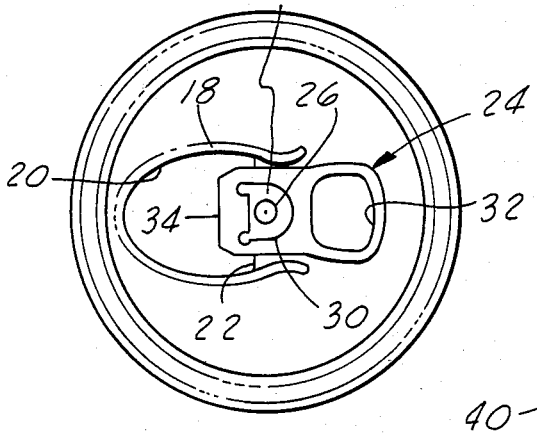
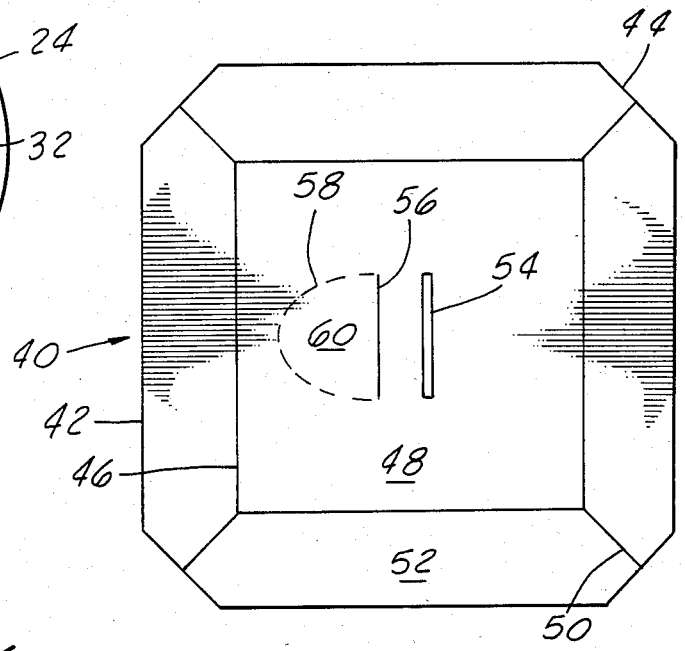
FIG. 2
FIG. 3
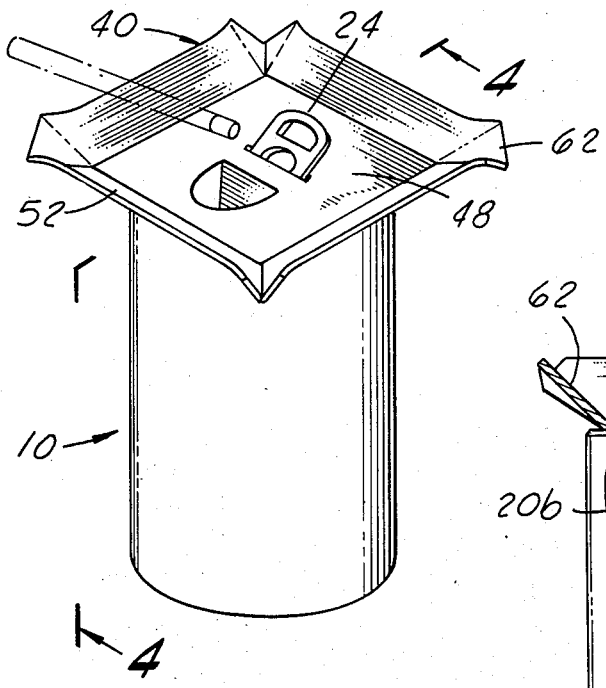
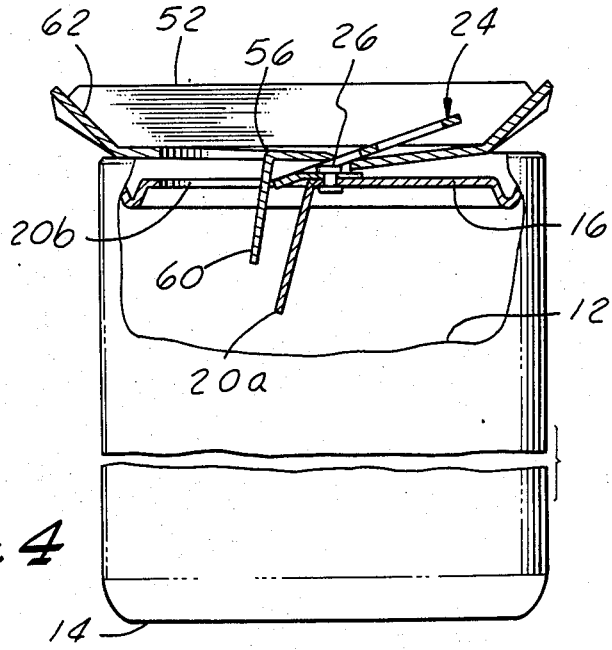
FIG. 4

DISPOSABLE ASHTRAY ATTACHMENT FOR BEVERAGE CANS

BACKGROUND OF THE INVENTION

The present invention relates to smokers' ashtrays adapted for temporary interconnection to the tops of beverage cans and, more particularly, to a disposable ashtray adapted for temporary attachment to the upper end of a "pop top" type of beverage can that has been opened.

SUMMARY

The ashtray of this invention comprises a thin, substantially square flat piece or blank of an aluminized sheet of paperboard, preferably having 45° cut corners. The blank is preferably die cut into the desired planform and may be on the order of 3½" across. On one side, the blank is formed with a floor and side-wall-defining pattern of crush scorelines each of which is parallel to and spaced inwardly about ⅝" from the corresponding edge of the blank. An additional crush scoreline is impressed in each corner extending normally to the corresponding 45° cut corner and terminating at its inner end in a corner of the score-defined square in the center of the blank. In the central floor area of the blank, preferably parallel to one of the edges, a passage means is formed, as by a punch or knife but, in any event, preferably of a width such that an upstanding pull tab of a beverage can can be snugly received into the slot or slit. Adjacent and parallel thereto, a crush scoreline of about the same length as the passage means is formed as the root end of an arcuate perforated scoreline whose opposite ends terminate at opposite ends of the crush scoreline. The area embraced within the perforated scoreline defines a key tab of a size to be receivable within the opening into the top of the beverage can on which the device is to be used.

After the top of a pop top beverage can has been opened the ashtray of this invention is used as follows. After the actuating handle or tab for the pop top can has been set at a desired angle relative to the top of the can, the slit in the floor of the ashtray is passed thereover. Either before or after this step the perforated score key tab is pressed downward out of the plane of the body of the blank to penetrate the opening into the top of the can. The ashtray is thus keylocked against displacement relative to the can top by virtue of the downwardly depending tab of the ashtray penetrating the can and the engagement of the pull tab of the can with the slit of the ashtray floor. The sidewalls of the ashtray can then be erected by folding along the crush scorelines extending in parallelism to the edges of the blank. There is thus defined at each cut corner of the ashtray an essentially upwardly concave trough adapted to support a cigarette or cigar in a downwardly inclined position. If desired, the inner burning end of the tobacco product can be supported on the top of or within an opening of the actuator handle of the can.

A plurality of the ashtray blanks of this invention, e.g., six in number, can be packaged together in a flat condition to occupy a minimum of space in a package of convenient size for carrying in a shirt pocket or purse, or for inclusion in a "sixpack" carton of beverage cans. After use, when it is desired to dispose of an ashtray, it can be readily folded up and thrown away into any convenient receptacle including the beverage can with which it was used.

BRIEF DESCRIPTION OF THE DRAWING

FIG. 1 is a substantially full scale top plan view of the top of an exemplary form of pop top beverage can with which the ashtray of this invention is usable.

FIG. 2 is a substantially full scale plan view of one side of the ashtray blank of the invention and essentially a mirror image of the other side.

FIG. 3 is a perspective view of the ashtray of the invention after the flat blank of FIG. 2 has been formed into an operative condition and affixed to an open pop top beverage can.

FIG. 4 is a partial sectional view taken in the plane of the line 4—4 of FIG. 3.

DESCRIPTION OF THE PREFERRED EMBODIMENT

While the invention will be explained in detail, it is to be understood that it is not limited in its application to the materials, the details of construction, and the arrangements of the components set forth in the description or illustrated in the drawings. The invention is capable of other embodiments and of being practiced and carried out in various ways. Also, it is to be understood that the phraseology and terminology employed herein are for the purposes of description and should not be regarded as limiting.

The drawings show a merely exemplary embodiment of a pop top beverage can 10. This can may be made of a spun or drawn metal, e.g., aluminum, and has a cylindrical side wall 12, a flat or sometimes inwardly dimpled bottom wall 14, and a top wall 16 that may be recessed slightly relative to a top circumferential flange or bead. The top 16 has a "pop top" opener mechanism and as such may, for example, have a raised integrally formed rib 18 of a generally horseshoe shaped configuration surrounding a frangible line 20, the opposite ends of which terminate at opposite ends of a straight bend line 22. Upon actuation of the pop top opener a tab portion **20*a* of the can top 16, embraced by the line 20, is severed from the balance of the top and bent inwardly into the interior of the can leaving a drink opening 20*b*. For that purpose the top of the can is fitted with an actuator handle, designated generally at 24, an inner end portion of which is secured to the can top 16 by means of a fastener or rivet 26. The fastener 26 extends through a semi-circular rivet tab portion 28 of the actuator handle 24, the tab 28 being separated from the body of the member 24 along a line 30, of substantially semicircular form, when an outer end loop 32 of the handle is lifted away from its normal position lying against the top 16. Thus, initial lifting of the actuator 24 causes an innermost end 34 of the actuator to open the can by tearing the tab 20*a*, enclosed by the tear line 20, downwardly and away from the can top after which, if desired, the now erect ring portion 32** of the actuator may be turned back in the opposite direction.

As stated, the particular configuration of can 10 illustrated in the drawings is merely exemplary and the ashtray of this invention is not limited in use to the specific embodiment of can illustrated. Rather, the invention is usable with any type of can, jug or container in which an opening can be formed in the top, cover or lid by means of an adjacent handle which, after actuation, can be left disposed at some angle relative to the plane of the top of the can.

The ashtray comprises a thin flat blank 40 which preferably has the planform of FIG. 2. The blank 40 may be made of any sheet material, e.g., aluminum foil or paperboard, which is resistant to ignition by the burning end of a cigar or cigarette, of sufficient thickness to be self-supporting in flat configuration, and of a sufficiently inelastic or stiff material to be essentially permanently or semi-permanently deformable into a cuplike shape, e.g., like that illustrated in FIG. 3. In its preferred form the blank 40 takes the form of a 10 or 12 point paper sheet material which is laminated on both sides with aluminum foil to have a 12 to 14 point finished gauge of thickness.

Preferably, the blank 40 is die cut into the essentially square configuration shown in FIG. 2 comprising four orthogonally related straight edges 42, adjacent ends of which are joined by a relatively short 45° cut corner 44. On one face, the blank is formed with four crush scorelines 46 each of which is parallel to the corresponding or adjacent outer edge 42. The four scorelines 46 together define a centrally disposed square 48 adapted to serve as the floor or bottom of the ashtray when it is fully formed and, preferably, large enough in area to fully cover the top of the can 10. Preferably, and assuming approximately a 3½" dimension across the blank 40, each of the crush scorelines 46 may be spaced on the order of ⅝" from the adjacent edge 42. In each corner area of the blank 40 another short crush scoreline 50 extends from a corner of the square area 48 outwardly to the center of the corresponding cut corner 44. The area bounded by a pair of lines 50, a line 46 and an edge 42 defines one of four similar sidewalls 52 on the ashtray.

At about the center of the floor portion 48 of the blank 40, a passage means, which may take the form of a narrow slit 54, is cut through the material of the blank of a length about the same as the width of the widest portion of the actuator handle 24 of the can 10 to be passed therethrough. Preferably, this slit is sufficiently narrow that its opposite long edges will snugly engage opposite sides of the actuator handle 24. While a through slit, slot or cut 54 is preferred the passage means could also, perhaps, take the form of a perforated score. However, a through slit, having a width defined by the kerf of the cutting tool or punch, is preferred as being easier to mount on the actuator handle 24.

Parallel to the slit 54, and spaced therefrom on the order of approximately ¼" in the illustrated case, is a crush scoreline 56, of substantially the same length as the slit 54, whose opposite ends terminate at opposite ends of an arcuate perforated scoreline 58 disposed on the opposite side of the score 56 from the slot 54. The area bounded by the scoreline 56 and score 58 comprises a key tab or lock tab 60, whose configuration may be substantially that of the tab **20*a* bounded by the frangible line 20 of the can top 16, or approximately so. It will be understood that the contour defined by the scoreline 58 should be such that when the key tab 60 is depressed downwardly out of the plane of the ashtray bottom 48, pivoting on hinge score 56 as shown in FIG. 4, that the opposite side edges of the tab 60, where it intersects the plane of the can top 16, engage opposite sides of the opening 20*b*** made in the top of the can after it has been opened.

The can 10 is opened in the usual manner by means of raising the loop handle 32 of the actuator 24 away from contact with top 16. As a result the can tab **20*a* is torn out of the plane of the can top 16 to bend on line 22 and protrude downwardly through opening 20*b* into the interior of the can, as indicated in FIG. 4**. When the contents of the can have been consumed, or substantially so, it provides a convenient fireproof receptacle into which the ashes of tobacco products, cigarette and cigar butts, and other burning or burnable material, such as matches of paper and wood, may be disposed, especially if a portion of the liquid product or added water is held at the bottom of the can.

Assuming the can 10 to be in readiness for use as a container for such waste, the actuator handle 24 can be adjusted to any desired convenient angle relative to the top of the can 16 such that the slot 54 of a blank 40 can be mounted thereon. It will be understood that in mounting the ashtray onto the container 10 by means of the slot 54 the blank 40 should be oriented such that its tearable tab or key lock portion 60 overlies the opening **20*b* which has been made in the can. The tray is then moved downwardly along the actuator 24 until its bottom or floor 48 abuts the the upper end of the can 10. In the illustrated case, with the particular exemplary embodiments of the ashtray and can illustrated, the floor of the ashtray seats on the upper end rim of the can 10 in slightly spaced relation above the recessed top 16 of the can. However, it should be appreciated that the invention is not limited to a square planform and could be devised with an accordian pleated wall surrounding a circular floor portion adapted to seat directly on top 16 of the can. In any event, after the ashtray has been seated in place its key tab 60 is manually severed, for example by thumb pressure along the line 58, to be folded into the penetrating position illustrated in FIG. 4. Thereafter, if not previously accomplished, the side walls 52 of the ashtray are manually erected by folding along the crush scorelines 46 thus creating an upwardly concave trough 62 in each corner of the ashtray adapted to securely hold a burning cigarette, for example. It will also be observed that the now upstanding loop end 32 of the actuator 24** provides a convenient means for knocking ashes off of the end of the burning tobacco product or as a rest for the lit end of the product.

Assuming the condition of FIG. 4 and, further, that no liquid is within the can 10 so that a lighted cigarette could remain burning after having been discarded into the can, the tab 60 provides a means of sufficiently impeding the flow of air into the can to ensure that a burning cigarette or the like would be extinguished notwithstanding the absence of any liquid. More specifically, the tab 24 can be turned to a more erect upstanding position such that the ashtray can be lifted sufficiently to expose the downwardly bent tab 60 which can then be manually turned back into the plane of the ashtray floor 48. Thereafter, the ashtray can be reseated back onto the top of the can 10 and, due to the area of the floor 48 and the tab 60 being in a closed condition, will sufficiently restrict the flow of fresh air into the can such that the burning cigarette will be extinguished and the escape of noxious fumes from the can will be stopped.

It will be seen that the combination of the mating engagement of the actuator 24 with the slot 54 of the ashtray and the penetration of the tab 60 into the interior of the can provide a very safe and secure interconnection between the two items preventing any significant displacement of the ashtray relative to the can. In that connection it will be observed from FIG. 4 that the actuator 24 can be pressed towards the can top 16 in order to clamp one edge of the slot 54 in the ashtray floor 48 between the underside of the actuator 24 and the upper surface of the can top 16 or top surface of the actuator tab portion 28. At any time, the ashes, cigarette and the disposable ashtray itself can be inserted into the opening 20*b* to totally conceal all evidence of smoking. A small amount of drinkable product or water within the can will ensure immediate smokeless dousing of the ashes and cigarette or the like.

I claim:

1. A blank for use on the top of a can in which an opening can be made through the top wall of the can by means of an actuator handle connected to the top wall of the can, said blank comprising:

a flat piece of a thin sheet material having a score to define a floor that is bordered by an area of the blank which can be erected into an upstanding wall;

said floor being formed with a passage means through which the actuator handle of the can top can be passed after the handle has been actuated to form an opening through the top wall of the can;

said floor also being formed with a key tab portion that is displaceable out of the plane of said floor for penetration into the opening made in the top wall of the can by the actuator handle;

said passage means through said floor and said key tab portion of said floor being so oriented relative to one another that said key tab portion is positioned for registration with the opening of the can top wall when the actuator handle has been inserted through said passage means of said floor.

2. The blank of claim 1 in which:

said passage means comprises a scoreline having a length sufficient to receive the width of the actuator handle of the can on which the blank is to be used.

3. The blank of claim 1 in which:

said passage means comprises a slot of a length and width to matingly receive the actuator handle of the can which the blank is to be used.

4. The blank of claim 1 in which:

said key tab portion comprises a perforated scoreline.

5. The blank of claim 1 in which:

said key tab portion has a configuration which is substantially that of the opening to be made in the top wall of the can by the actuator handle.

6. The blank of claim 1 in which:

said key tab portion comprises a hinge defined by a press score in said thin sheet material, the opposite ends of said hinge terminating at opposite ends of an arcuated perforated scoreline.

7. The blank of claim 6 in which:

said key tab portion has a width such that opposite sides of the key tab portion engage opposite edges of the opening in the top wall of the can after said key tab portion has been displaced out of the plane of the floor for penetration into the opening made into the top wall of the can by the actuator handle.

8. The blank of claim 1 in which:

said floor has a quadrangular planform.

9. The blank of claim 8 in which:

said floor has a rectangular planform.

10. The blank of claim 9 in which:

said floor defining score is centrally disposed on said blank with the sides of said floor in parallel spaced relation to the edges of said blank;

the edges of said blank being formed with 45° cut corners, corner areas of said blank each being formed with a scoreline disposed normally to the corresponding cut corner and having its inner end intersecting a corner of said floor defining score, whereby upon erecting of the wall areas of the blank an upwardly concave trough is defined at each of said cut corners of said blank.

11. The blank of claim 1 in which:

said floor area has a circular planform.

12. The blank of claim 1 in which:

said thin sheet material comprises aluminum foil.

13. The blank of claim 1 in which:

said thin sheet material comprises a paperboard material.

14. An ash receiver comprising:

a beverage can, and a tray mounted on top of said can;

said can having a top wall in which an opening has been formed by means of an actuator handle integrally mounted on said top wall;

said tray comprising a floor area having a passage means through which said actuator handle extends when said tray is seated on the top of said can;

said floor area having an opening therethrough in registration with said opening in said top wall of said can.

15. The ash receiver of claim 14 in which:

said floor area also has an integral key tab portion having a free end which has been deflected out of the plane of said opening of said floor to project through said opening in said top wall and into the interior of said can.

16. The ash receiver of claim 15 in which:

said tray comprises a thin sheet of a stiff material that has been scored to define wall areas around said floor of said tray;

said wall areas being folded to an upright position relative to said floor.

17. The ash receiver of claim 16 in which:

said floor area of said tray is rectangular, each of the corner areas of said tray being formed with a 45° cut corner;

each of said corner areas of said tray having a radially oriented scoreline such that the upright wall areas of said tray define a concave trough in the corner area.

18. The ash receiver of claim 14 in which:

said passage means of said floor area of said tray comprises a slot of a configuration to matingly receive said actuator handle;

one edge of said slot being clamped between the inner end of said actuator handle and said top wall of said can.

* * * * *